US011761721B2

(12) United States Patent
Nakayama et al.

(10) Patent No.: US 11,761,721 B2
(45) **Date of Patent: *Sep. 19, 2023**

(54) COMPACT ANTI-TILT FOLLOWER FOR AN AMMUNITION MAGAZINE

(71) Applicant: Magpul Industries Corp., Austin, TX (US)

(72) Inventors: Brian L. Nakayama, Arvada, CO (US); Nicholas Kielsmeier, Denver, CO (US); Eric Nakayama, Broomfield, CO (US); Eric C. Burt, Broomfield, CO (US)

(73) Assignee: Magpul Industries Corp., Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/475,415

(22) Filed: Sep. 15, 2021

(65) Prior Publication Data

US 2021/0404757 A1 Dec. 30, 2021

Related U.S. Application Data

(63) Continuation of application No. 16/779,107, filed on Jan. 31, 2020, now Pat. No. 11,150,041, which is a continuation of application No. 16/192,091, filed on Nov. 15, 2018, now Pat. No. 10,641,565, which is a continuation of application No. 15/429,596, filed on Feb. 10, 2017, now Pat. No. 10,161,698, which is a continuation of application No. 14/730,141, filed on Jun. 3, 2015, now abandoned.

(60) Provisional application No. 62/007,270, filed on Jun. 3, 2014.

(51) Int. Cl.
*F41A 9/65* (2006.01)
*F41A 9/70* (2006.01)

(52) U.S. Cl.
CPC ..... *F41A 9/70* (2013.01)

(58) Field of Classification Search
CPC ..... F41A 9/70; F41A 9/65; F41A 9/69; F41A 9/62; F41A 9/83
USPC ..... 42/50
See application file for complete search history.

(56) References Cited

U.S. PATENT DOCUMENTS 1,323,063 A 11/1919 Johnson et al.
2,715,789 A 8/1955 Garand
3,465,463 A 9/1969 Grandy et al.
(Continued)

OTHER PUBLICATIONS

David, Michael D., "Office Action Regarding U.S. Appl. No. 15/429,596", dated Jul. 26, 2018, p. 19, Published in: US.
(Continued)

*Primary Examiner* — Michael D David
(74) *Attorney, Agent, or Firm* — Neugeboren O'Dowd PC

(57) ABSTRACT

A firearm magazine assembly and a related method are disclosed. The follower has a top platform, a proximal end, a distal end, and at least one slider rail on a first side of the follower. At least a portion of the at least one slider rail is at a position that is between and remote from both the proximal end of the follower and the distal end of the follower. The housing is shaped to receive the follower. The housing has a first wall having a first recess for receiving the at least one slider rail, the first recess defined by opposing surfaces. At least a portion of the at least one slider rail is shaped to engage the two opposing surfaces to limit tilt of the follower.

20 Claims, 9 Drawing Sheets

(56) References Cited

U.S. PATENT DOCUMENTS

| | | | |
|---|---|---|---|
| D244,285 | S | 5/1977 | Sofinowski |
| 4,109,401 | A | 8/1978 | Musgrave |
| 4,495,720 | A | 1/1985 | Bross |
| 4,502,237 | A | 3/1985 | Krogh |
| 4,672,760 | A | 6/1987 | Chesnut et al. |
| 4,790,094 | A | 12/1988 | Chestnut et al. |
| 5,113,605 | A | 5/1992 | Kim |
| 5,263,273 | A | 11/1993 | Lishness |
| 5,329,718 | A | 7/1994 | Howard |
| 5,357,703 | A | 10/1994 | Chestnut et al. |
| 5,638,626 | A | 6/1997 | Westrom |
| 5,956,878 | A | 9/1999 | Yang |
| 7,533,483 | B1 | 5/2009 | Alazmora et al. |
| D615,143 | S | 5/2010 | Fitzpatrick et al. |
| D644,293 | S | 8/2011 | Fitzpatrick et al. |
| 3,006,423 | A1 | 8/2011 | Alzamora et al. |
| D645,113 | S | 9/2011 | Fitzpatrick et al. |
| 8,028,455 | B1 | 10/2011 | Battaglia |
| 8,069,601 | B1 | 12/2011 | Fitzpatrick et al. |
| 8,225,541 | B2 | 7/2012 | Bigley et al. |
| D667,915 | S | 9/2012 | Nakayama et al. |
| 8,485,083 | B1 | 7/2013 | Care |
| 8,635,796 | B2 | 1/2014 | Fitzpatrick et al. |
| 8,720,094 | B2 | 5/2014 | McPherson |
| 8,752,322 | B2 | 6/2014 | Kresser et al. |
| 8,887,428 | B1 | 11/2014 | Lemoine |
| D719,235 | S | 12/2014 | Mikroulis |
| 8,991,086 | B2 | 3/2015 | Fitzpatrick et al. |
| D735,831 | S | 8/2015 | Faifer |
| D745,945 | S | 12/2015 | Kielsmeier et al. |
| 9,207,029 | B2 | 12/2015 | Klarborg |
| 9,222,739 | B1 | 12/2015 | Bennett et al. |
| 9,255,749 | B2 | 2/2016 | Faifer |
| D755,336 | S | 5/2016 | Nakayama et al. |
| 9,347,721 | B2 | 5/2016 | Larson, Jr. |
| 9,383,152 | B2 | 7/2016 | Nakayama et al. |
| 9,470,464 | B2 | 10/2016 | Kielsmeier et al. |
| 10,161,698 | B2 | 12/2018 | Nakayama et al. |
| 10,641,565 | B2 | 5/2020 | Nakayama et al. |
| 11,150,041 | B2 * | 10/2021 | Nakayama ..... F41A 9/70 |
| 2009/0107022 | A1 | 4/2009 | Fitzpatrick et al. |
| 2010/0126053 | A1 | 5/2010 | Fitzpatrick et al. |
| 2010/0251590 | A1 | 10/2010 | Fitzpatrick et al. |
| 2010/0281737 | A1 | 11/2010 | Cahill |
| 2011/0005113 | A1 | 1/2011 | Fitzpatrick et al. |
| 2011/0113663 | A1 | 5/2011 | Nakayama et al. |
| 2011/0214326 | A1 | 9/2011 | Inskeep et al. |
| 2012/0066950 | A1 | 3/2012 | Davidson |
| 2012/0167429 | A1 | 7/2012 | Sullivan |
| 2013/0167420 | A1 | 7/2013 | Zheng |
| 2013/0167421 | A1 | 7/2013 | Zheng |
| 2013/0180146 | A1 | 7/2013 | Fitzpatrick et al. |
| 2014/0075810 | A1 | 3/2014 | Mikroulis |
| 2014/0352189 | A1 | 12/2014 | Fitzpatrick et al. |
| 2015/0241152 | A1 | 8/2015 | Fitzpatrick et al. |
| 2015/0292826 | A1 | 10/2015 | Kielsmeier et al. |
| 2015/0345882 | A1 | 12/2015 | Nakayama et al. |
| 2016/0116239 | A1 | 4/2016 | Nakayama et al. |
| 2017/0153076 | A1 | 6/2017 | Nakayama et al. |
| 2019/0086170 | A1 | 3/2019 | Nakayama et al. |
| 2020/0292262 | A1 | 9/2020 | Nakayama et al. |

OTHER PUBLICATIONS

David, Michael, "Office Action Regarding U.S. Appl. No. 15/429,596", dated Apr. 5, 2018, p. 23, Published in: US.

Gruber, Steve, "Response to Office Action Regarding U.S. Appl. No. 15/429,596", dated May 30, 2018, p. 7, Published in: US.

Gruber, Stephen, "Response to Office Action Regarding U.S. Appl. No. 15/429,596", dated Sep. 25, 2018, p. 13, Published in: US.

David, Michael D., "Office Action Regarding U.S. Appl. No. 14/730,141", dated Mar. 11, 2016, p. 19, Published in: US.

Accurate Mag, "Magazines", Webpage found at http://accurate-mag.com/magazines/, Inventor(s) aware of prior art on or before Jun. 30, 2015, p. 5, Published in: USA.

Midway USA, "AICS Short Action 308 Winchester Steel Matte", Webpage found at http://www.midwayusa.com/product/2898468203/accuracy-international-magazine-accuracy-international-chassis-system, Inventor(s) aware of prior art on or before Jun. 30, 2015, p. 3, Published in: US.

Triad Tactical Inc., "System Short Action 5 Round Magazine", Webpage found at https://www.triadtactical.com/Accuracy-International-Chassis-System-Short-Action-5-round-magazine.html, Inventor(s) aware of prior art on or before Jun. 30, 2015, p. 3, Published in: USA.

Alpha Industries, "Alpha Type 1 Magazine / AICS Short Action 308", Webpage found at http://www.alphaindmfg.com/store/index.php?route=product/product&product_id=50, Inventor(s) aware of prior art on or before Jun. 30, 2015, , p. 1, Published in: USA.

Midway USA, "C Products AICS Ruger Gunsite Scout 308 Winchester 10-Round Stainless Steel Black", Webpage found at http://www.midwayusa.com/product/628477/c-products-magazine-accuracy-international-chassis-system-aics-ruger-gunsite-scout-308-winche, Inventor(s) aware of prior art on or before Jun. 30, 2015, p. 2, Published in: USA.

KEL-TEC CNC Industries Inc., "PMR-30 Magazine", Webpage found at http://www.keltecweapons.com/pmr-30/pmr-30-accessories/pmr-30-magazine-30rnd/, Inventor(s) aware of prior art on or before Jun. 30, 2015, p. 1, Published in: USA.

Modular Driven Technologies Corp., "10 Round .308 Magazine", Webpage found at http://mdttac.com/short-action-223-and-308-magazines-308-10r.html, Inventor(s) aware of prior art on or before Jun. 30, 2015, p. 4, Published in: US.

Magpul Industries, Inc., "PMAG Magazines", Webpage found at https://www.magpul.com/products/pmag-magazines, Inventor(s) aware of prior art on or before Jun. 30, 2015, p. 11, Published in: USA.

Sturm Ruger & Co., Inc., "308 Win. 10-Round Magazine", Webpage found at http://shopruger.com/308-Win-10-Round-Magazine/productinfo/90355/, Inventor(s) aware of prior art on or before Jun. 30, 2015, p. 2, Published in: US.

Sturm Ruger & Co., Inc., "308 WIN. 5-Round Magazine", Webpage found at http://shopruger.com/308-Win-5-Round-Magazine/productinfo/90354/, Inventor(s) aware of prior art on or before Mar. 23, 2015, p. 1, Published in: US.

* cited by examiner

COMPACT ANTI-TILT FOLLOWER FOR AN AMMUNITION MAGAZINE

CROSS-REFERENCE TO RELATED APPLICATIONS

This application is a continuation of U.S. patent application Ser. No. 16,779,107 filed on Jan. 31, 2020 and entitled "COMPACT ANTI-TILT FOLLOWER FOR AN AMMUNITION MAGAZINE," and issued as U.S. Pat. No. 11,150,041 on Oct. 19, 2021, which is a continuation of U.S. patent application Ser. No. 16,192,091 filed on Nov. 15, 2018 and entitled "COMPACT ANTI-TILT FOLLOWER FOR AN AMMUNITION MAGAZINE," and issued as U.S. Pat. No. 10,641,565 on May 5, 2020, which is a continuation of U.S. patent application Ser. No. 15/429,596 filed on Feb. 10, 2017 and entitled "COMPACT ANTI-TILT FOLLOWER FOR AN AMMUNITION MAGAZINE," and issued as U.S. Pat. No. 10,161,698 on Dec. 25, 2018, which is a continuation of U.S. patent application Ser. No. 14/730,141 filed on Jun. 3, 2015 and entitled "COMPACT ANTI-TILT FOLLOWER FOR AN AMMUNITION MAGAZINE," which claims priority to U.S. Provisional Application No. 62/007,270 filed Jun. 3, 2014 and entitled "COMPACT ANTI-TILT FOLLOWER FOR AN AMMUNITION MAGAZINE," the entire disclosures of which are hereby incorporated by reference for all purposes, as if fully set forth herein.

COPYRIGHT

A portion of the disclosure of this patent document contains material that is subject to copyright protection. The copyright owner has no objection to the facsimile reproduction by anyone of the patent disclosure, as it appears in the Patent and Trademark Office patent files or records, but otherwise reserves all rights available and provided by copyright law.

FIELD OF THE INVENTION

The present invention relates to the field of firearms. In particular, but not by way of limitation, the present invention relates to an improved follower and casing for an ammunition magazine.

BACKGROUND OF THE INVENTION

Firearm magazines are regularly used with firearms to allow for convenient storage and feeding of multiple cartridges to a firearm. Traditional magazines generally have a spring-loaded follower for guiding cartridges through the magazine housing to the top or mouth of the magazine where a firearm bolt can push one cartridge at a time into a chamber of the firearm. Although traditional magazines are generally functional, many types may be prone to jamming, can be unreliable, or are otherwise unsatisfactory. Moreover, it is desirable to provide for smaller or more compact followers and/or smaller magazine housings. Accordingly, a system and method are needed to address the shortfalls of present technology and to provide other new and innovative features.

SUMMARY

Exemplary aspects of the present disclosure that are shown in the drawings are summarized below. The word "exemplary" is used herein to mean "serving as an example, instance, or illustration." Any embodiment or aspect described herein as "exemplary" is not necessarily to be construed as preferred or advantageous over other embodiments or aspects.

An exemplary firearm magazine assembly has a follower and a housing. The exemplary follower has a top platform, a proximal end, a distal end, and at least one slider rail on a first side of the follower, at least a portion of the at least one slider rail at a position that is between and remote from both the proximal end of the follower and the distal end of the follower. The exemplary housing is shaped to receive the follower, the housing having a first wall having a first recess for receiving the at least one slider rail, the first recess defined by opposing surfaces. At least a portion of the at least one slider rail is shaped to engage the two opposing surfaces to limit tilt of the follower.

An exemplary method of using a firearm magazine assembly includes providing a firearm magazine assembly having a follower and a housing. The follower has a top platform, a proximal end, a distal end, and at least one slider rail on a first side of the follower. At least a portion of the at least one slider rail is at a position that is between and remote from both the proximal end of the follower and the distal end of the follower. The housing is shaped to receive the follower and has a first wall having a first recess for receiving the at least one slider rail, the first recess defined by opposing surfaces. The exemplary method further includes causing at least a portion of the at least one slider rail to engage the two opposing surfaces to limit tilt of the follower.

These and other examples and aspects are more fully described in the Detailed Description section. It is to be understood, however, that there is no intention to limit the invention to the forms described in this Summary or in the Detailed Description. One skilled in the art can recognize that there are numerous modifications, equivalents and alternative constructions that fall within the spirit and scope of the invention as expressed in the claims.

BRIEF DESCRIPTION OF THE DRAWINGS

Various objects and advantages and a more complete understanding of the present invention are apparent and more readily appreciated by reference to the following Detailed Description and to the appended claims when taken in conjunction with the accompanying Drawings wherein:

DETAILED DESCRIPTION

As discussed above, in one exemplary embodiment the present disclosure describes a compact anti-tilt follower for a firearm magazine as will be described below. The follower can be produced in a more compact fashion (e.g., having a shorter overall height) by using a substantially vertical slider rail along one or more sides of the follower having a greater aspect ratio (length over width) than prior art anti-tilt features. The greater aspect ratio enables more anti-tilt effect from the slider than prior-art designs and thereby enables a shorter follower with the same or better anti-tilt abilities than prior art designs. Advantages of a more compact follower are less friction with an inside of a magazine housing and a magazine that can potentially house more cartridges. In another exemplary embodiment, this disclosure describes a housing for a firearm magazine, which will be described in further detail below. In a third exemplary embodiment, the disclosure describes a magazine assembly having a compact anti-tilt follower and a firearm magazine housing as described below.

Figure 1:
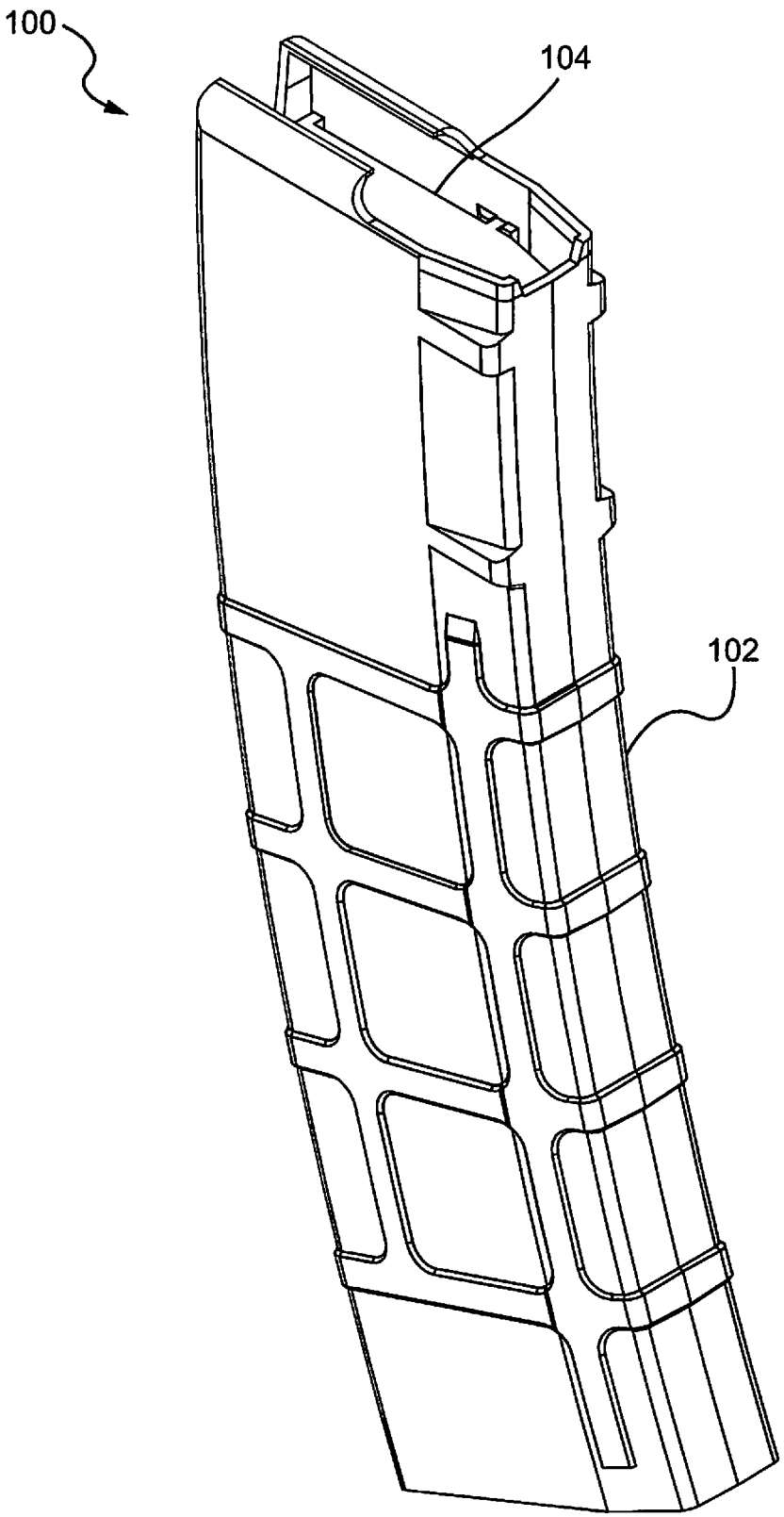
FIG. 1 is a perspective view of an embodiment of a magazine assembly.

Referring now to the drawings, where like or similar elements are designated with identical reference numerals throughout the several views, FIG. 1 illustrates an embodiment of a magazine assembly 100 for storing and feeding cartridges to a chamber of a firearm. The magazine assembly 100 comprises a housing 102 and a follower 104. The follower 104 is assembled within the housing 102, and is configured to guide cartridges towards an exit or feed lips of the housing 102. Although not depicted, it will be understood by those skilled in the art that the magazine assembly 100 may include other components, such as a spring for spring-loading the follower 104 within the housing 102, as well as a bottom end for affixing a spring-loaded follower 104 to the housing 102. Similarly, some of the various components of the magazine assembly 100 disclosed herein may be manufactured as a unitary component, or they may be assembled/coupled together to create the components discussed.

Figure 2:
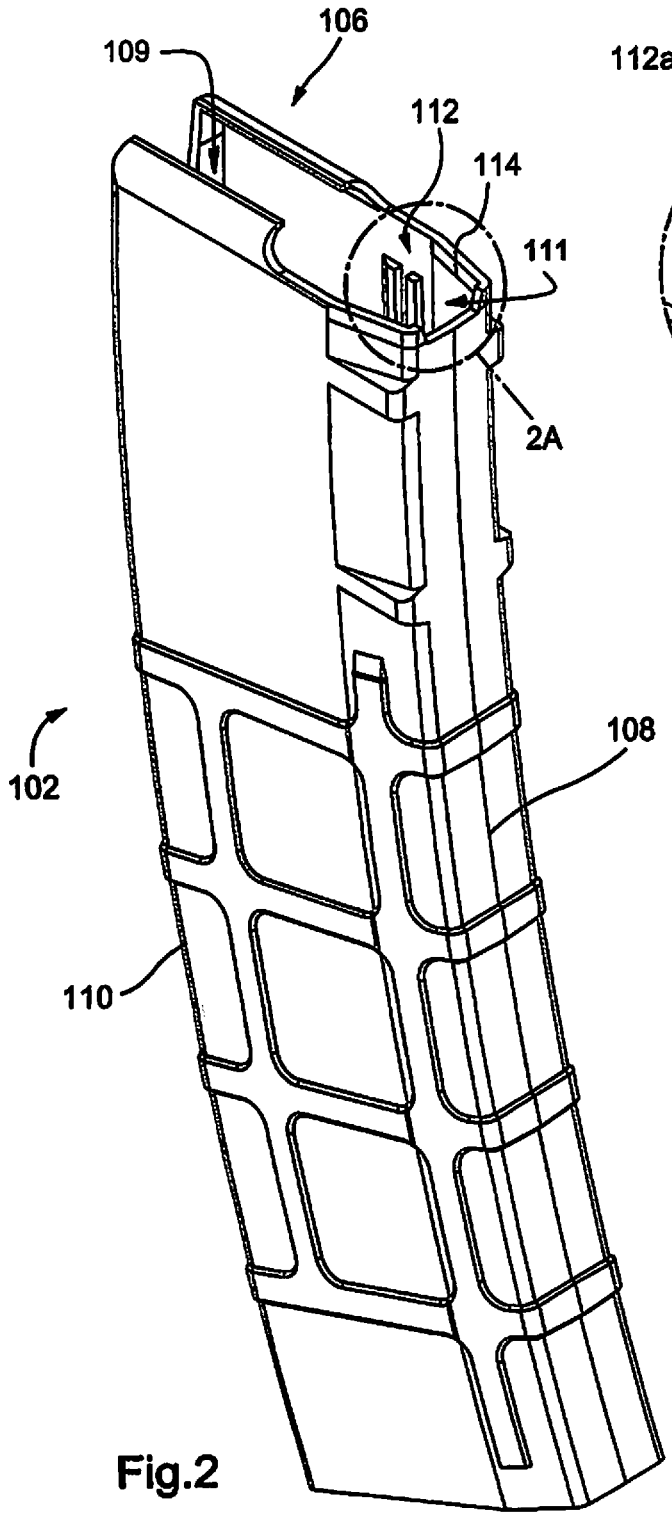
FIG. 2 is a perspective view of a housing of the magazine assembly in FIG. 1.

Referring now to FIG. 2, the housing 102 is discussed in more detail. The housing 102 may be manufactured of high strength synthetic materials, plastics, composites, ceramics, various metals including aluminum, stainless steel or alloys, or any other material suitable for the intended use with a firearm, and it may have a surface finish suitable to minimize friction with a follower 104 therein, as well as an external profile suitable for handling. A top end 106 of the housing 102 is configured to attach to a firearm (e.g., to mate with a magazine well), as well as to control the feeding of cartridges into the firearm chamber most often by a feed lip at the top end 106. The housing 102 may be configured to be permanently attached to a firearm, for example as part of an internal box or fixed magazine, or the housing 102 may be configured to be removably attached to a firearm, for example as a detachable box magazine. The top end 106 may be configured to guide double-stacked cartridges into a feed position, or the top end 106 may be configured to guide single-stacked cartridges into a feed position. The housing 102 may also be configured to guide cartridges from double or quad stack to single stack formations for feeding. The stack, whether single, double, or quad stack, may follow a path that is straight, a planer radius, a spherical radius, a spiral, a helix or any combination of the preceding.

Continuing with FIG. 2, a front or distal side 108 of the housing 102 is shown. For purposes of this disclosure, the term "distal" shall refer to those portions of a component associated with the tip or projectile end of a last cartridge in the magazine assembly 100 (i.e., a cartridge in contact with a top of the follower). To simplify discussion of the magazine assembly 100, the remainder of this disclosure will use the terms "a cartridge" or "the cartridge" to refer to the last cartridge in the magazine assembly 100. That is, the distal side 108 of the housing 102 is the side towards which cartridge would point when cartridges are loaded into the housing 102. Similarly, the housing 102 has a proximal side 110, with the proximal side 110 being associated with the primer or case end of cartridge. That is, when loaded into the housing 102, cartridges would point away from the proximal side 110 of the housing 102.

The housing 102 may also be curved, as shown in the figures, to provide for smooth feeding of the cartridges; however, it should be understood by those skilled in the art that the housing 102 may be straight in some embodiments. That is, for the purposes of this disclosure, the term "curvature" may in some embodiments be used to describe a feature having a curvature of infinite radius that is straight, a planer radius, a spherical radius, a spiral, a helix or any combination of the preceding. Moreover, the housing 102 may be configured to hold relatively few rounds, or up to a hundred rounds or more, with thirty rounds being a standard capacity in some embodiments. The top end 106 of the housing 102 may be interchangeable with other types of magazine housings.

Figure 2A:
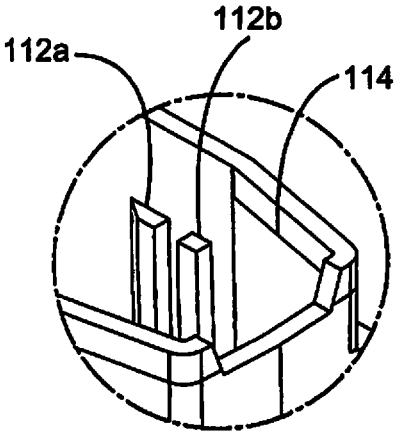
FIG. 2A is a detailed view of a top portion of the magazine assembly housing in FIG. 1.

Referring now to FIG. 2A in light of FIG. 2, a detailed view of a portion of the housing 102 is shown. FIG. 2A illustrates a bearing 112 on the inside wall of a side of the housing 102. The bearing 112 may have two ridges or ribs 112*a*, 112*b* protruding from the inside wall, forming a recess for guiding the follower 104. The bearing 112 and side of the housing 102 may be molded or machined as a unitary component, or the bearing 112 may be separately manufactured and affixed to the inside wall of the side. As mentioned, the bearing 112 is shown in this embodiment as a recess created from two ridges protruding from the side of the housing 102. The recess created by the ridges may be of a rectangular shape for providing a bearing surface for guiding the follower 104 along a desired path within the housing 102. This square or rectangular recess may provide for ease of manufacturing, and, as will be understood by the skilled person, minimize the types of directional forces each component of the bearing 112 will address. In some embodiments, portions or all of the housing 102 may be manufactured of a clear material so as to provide a visual aide to the user. In some embodiments, the bearing 112 may be a curved bearing rail. In some embodiments, the bearing 112 may be a recess in the housing 102 (e.g., see 712 in FIG. 7), or the bearing 112 may be formed by the ribs 112*a*, 112*b* as illustrated.

In FIGS. 2 and 2A, a top portion of the bearing 112 or ribs 112*a*, 112*b* is shown. As seen, the bearing extends to a location just below the exit or feed lips of the housing 102. Similarly, the bearing 112 may extend the full length of the housing 102, to the bottom of the housing, to allow the follower 104 to be inserted into the housing 102 after the sides of the housing 102 have been assembled. That is, the bearing 112 may allow for the follower 104 and a replacement bottom of the housing 102 to be inserted after-market. In some embodiments, however, the bearing 112 may extend only part of the way to a bottom of the housing 102 to allow only for travel of the follower 104 to a position near, but not at, the bottom of the housing 102. In such embodiments, it will be understood that after-market insertion of the follower 104 would not be possible, which may be advantageous in preventing misuse.

The second side of the housing 102 may also have a bearing 112 on the inside wall thereof (not visible in FIG. 2).

Figure 3:
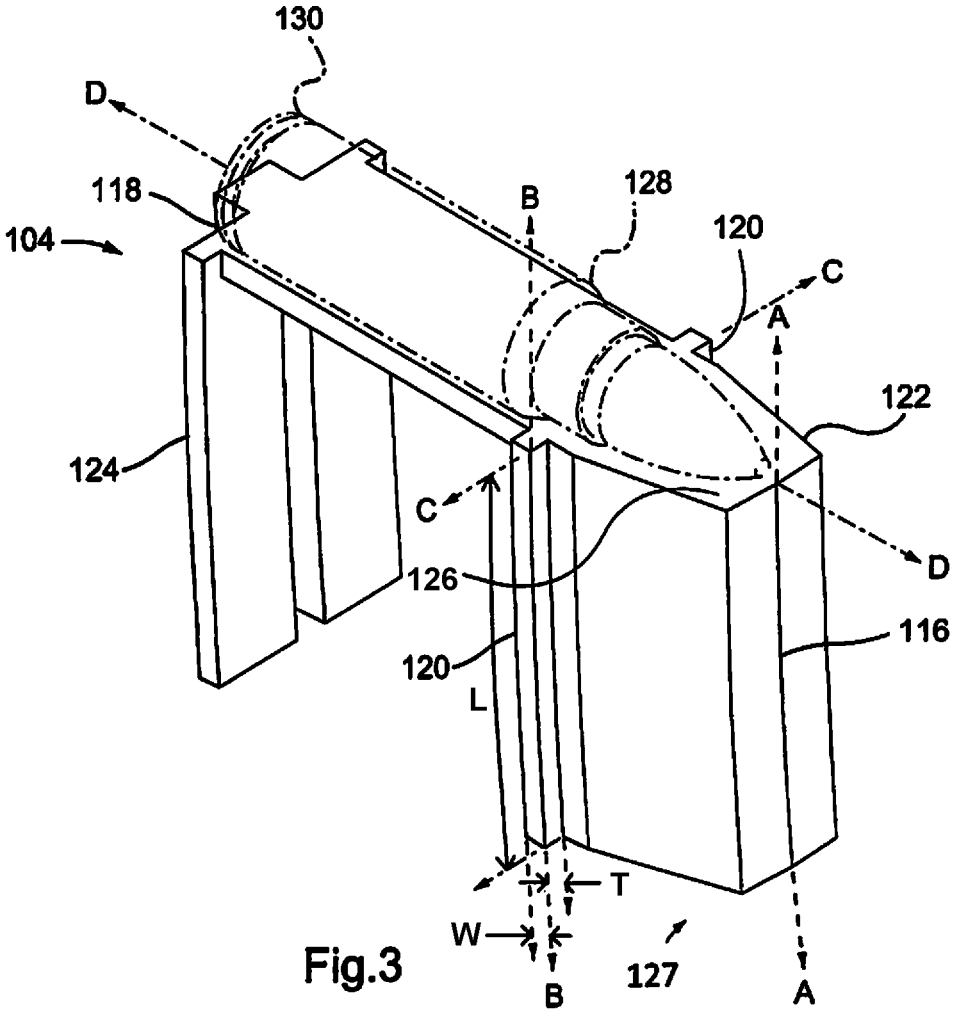
FIG. 3 a perspective view of the follower in FIG. 1.

Referring now to FIG. 3, the follower 104 shown in FIG. 1 is discussed in more detail. The follower 104 may be manufactured of high strength synthetic materials, plastics, various metals including stainless steel or alloys, or any other material suitable for the intended use with a firearm, and it may have a surface finish suitable to minimizing friction with a housing 102 and/or a cartridge. The follower 104 has a front or distal end 116, a back or proximal end 118, a top platform 126, and at least one slider rail, or slider 120. The top platform 126 can be configured to guide one or more cartridges towards an exit of the housing 102, and has a distal region, a case shoulder region, and a case head region. The distal region corresponds to a tip of the cartridge, the case shoulder region corresponds to a shoulder 128 of the cartridge case, and the case head region corresponds to a case head 130 of the cartridge. The proximal end 118 may have a first surface shaped to engage a proximal interior region 109 of the housing, and the distal end 116 may include a second surface shaped to engage a distal interior region 111 of the housing, as illustrated in FIG. 2. Of note, the slider 120 extends from the top platform 126 at a position that is between and remote from both the proximal end 118 of the follower and the distal end 116 of the follower. The slider may be an elongated protrusion, and may be curved or straight. The slider 120 may also have a greater aspect ratio than anti-tilt devices known in the art (e.g., having a greater ratio of length (L) to width (W)), thereby enabling a more compact follower with the same if not better anti-tilt capabilities.

The slider 120 is configured to control the tilt of the follower 104 as the follower 104 moves within the housing 102. In the illustrated embodiment, the slider 120 has a curvature that may mimic a curvature of an inside of the housing 102 (e.g., a constant internal curvature). In some embodiments, however, the follower 104, and axis B, may not be curved at all, or not have the same curvature, even where the bearing 112 is curved, so long as the tolerances are chosen to allow the follower 104 to smoothly pass through the housing 102. For example, a slider 120 may have an infinite curvature (that is, straight), yet still be used in a curved housing 102. In this straight slider 120 embodiment, the curvature of the slider 120 does not mimic the curvature of the inside of the housing 102. Like with the housing 102, the slider 120 may follow a path that is straight, a planer radius, a spherical radius, a spiral, a helix or any combination of the preceding. Furthermore, the slider 120 may be partially curved; that is, the 120 may follow axis B for a portion of the length of the slider 120, and follow a straight line for another portion of the length of the slider 120. The axis B may correspond to a curvature in the bearing 112, but it need not necessarily do so.

It will be understood by those skilled in the art and active in the firearms industry that the general term "tilt" may be used to describe the tilting about one or more of the pitch, roll, and yaw axes. In FIG. 3, axis A defines the yaw axis, axis D defines the roll axis, and axis C defines the pitch axis. If uncontrolled or unpredictable, this tilt is undesirable, because it adversely affects weapon reliability. Applicants have developed an elegant solution to control tilt of the follower 104, thus improving weapon reliability and safety. Moreover, controlling the tilt of the follower 104 in this manner results in a more compact design, as compared to the prior art, and allows an anti-tilt follower to be used in smaller capacity magazines without utilizing as much space as the prior art.

As shown in FIG. 3, the slider 120 may be configured to interface with the bearing 112 of the housing 102. The slider 120 is configured to prevent the follower 104 from tilting about a roll, and/or yaw axis and present a desired pitch depending on the follower's 104 position within the housing 102. In some embodiments, tilt about the yaw and roll axes are more tightly controlled than the tilt about the pitch axis. In some embodiments, the tilt of the follower 104 about the pitch axis is controlled such that the change in pitch is linearly related to an angular displacement along a curve within the housing 102. In some embodiments, the tilt about the pitch, that is, the rotation about axis C, is controlled so as to vary at an increasing rate or decreasing rate along the long or yaw axis A.

Figure 5:
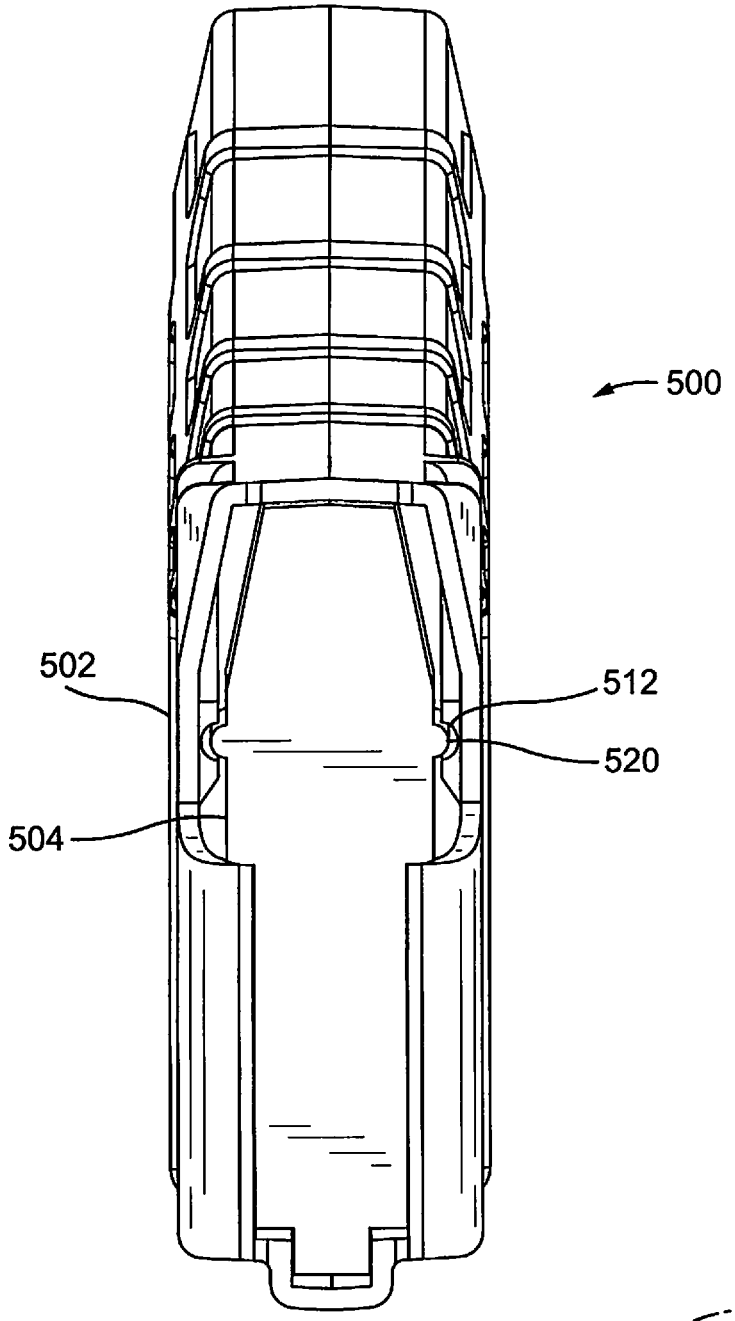
FIG. 5 is a top view of another embodiment of a magazine assembly.
Figure 5A:
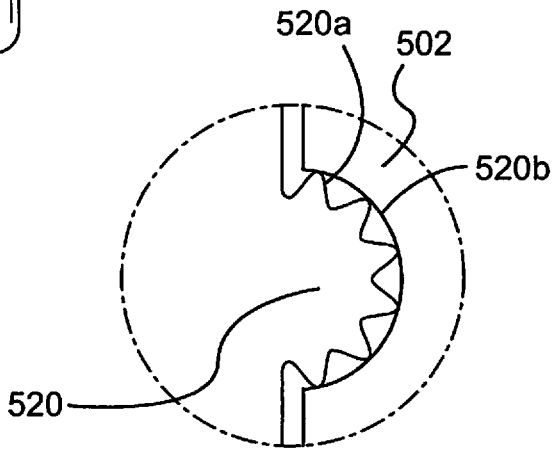
FIG. 5A is a top view of a portion of another embodiment of a magazine assembly.
Figures 6, 6A:
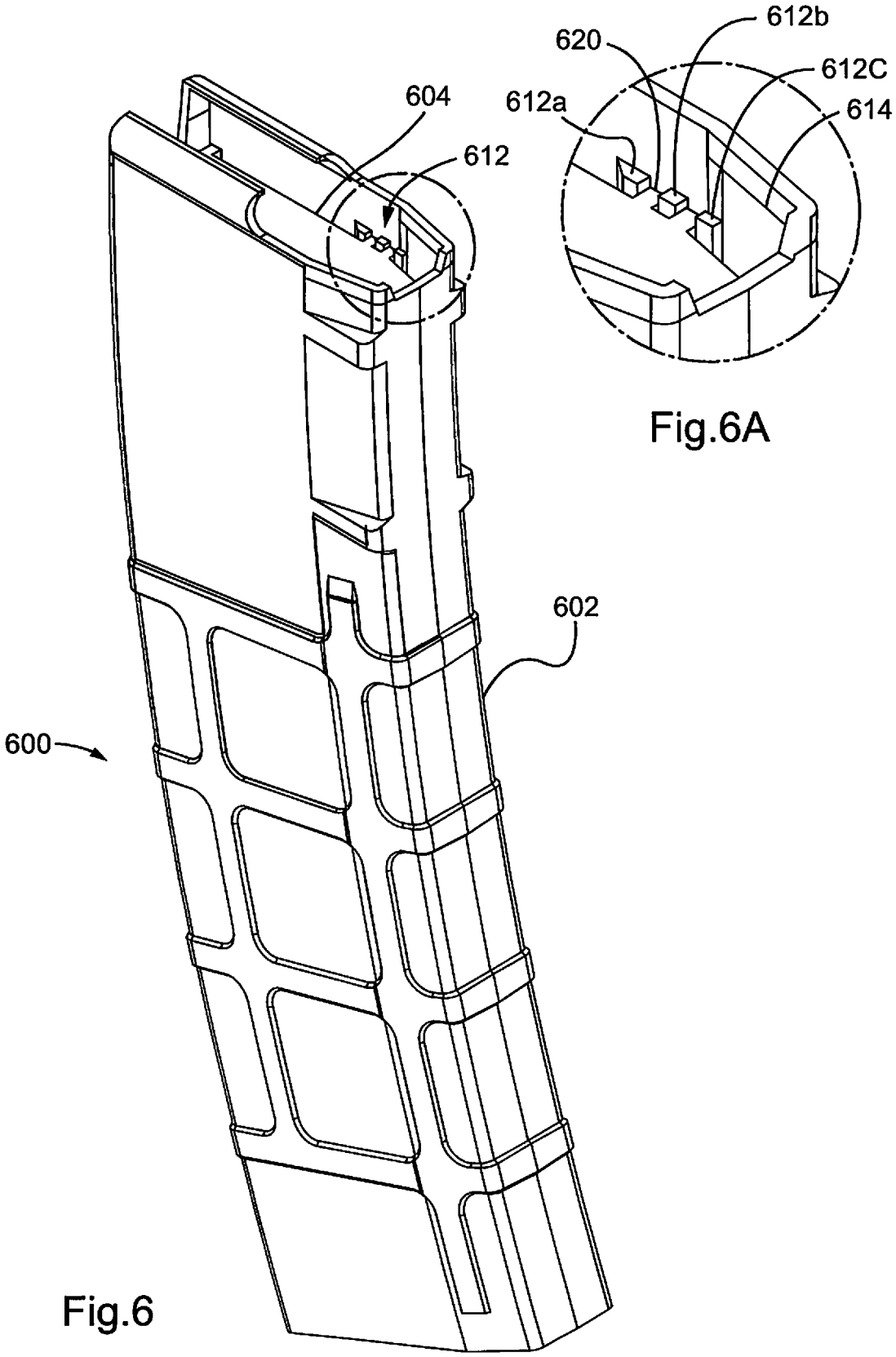
FIG. 6 is a perspective view of another embodiment of a magazine assembly.
FIG. 6A is a detailed view of a top portion of the magazine assembly in FIG. 6.

As depicted in FIG. 3, the slider 120 may be a protrusion or rib extending from the side of the follower 104. The slider 120 may also have in some embodiments a square or rectangular profile, to match a square or rectangular recess formed by the bearing 112 in the housing 102, and, as previously discussed, to control the types of forces the slider 120 may experience. In other embodiments, the slider 120 may have other profiles, such as having one or more non-perpendicular angles, one or more beveled edges, one or more curved edges (e.g., FIG. 5), two or more edges that are oblique to each other, or at least one edge that is oblique to an inner surface of the housing 102, to name a few non-limiting examples. It should also be understood that the slider 120 need not necessarily extend along the entirety of axis B as shown. A notched slider 120, wherein the slider 120 protrudes from the side of the follower 104 at various places along axis B is possible. Similarly, the slider 120 may extend along only a portion of the side of the housing 102. Similarly, the slider 120 may have more or fewer contact surfaces 390 (shown in FIG. 3A) than those shown in FIG. 3. For example, as shown in FIG. 5, a slider 520 having a half-moon profile provides for one contact surface. As another example, the slider 520 may have a series of projections 520*a*, 520*b* (shown in FIG. 5A) that provide more contact surfaces, with or without the bearing 512 being modified accordingly, as seen in FIGS. 5, 5A and 6A. The projections may follow a linear path, as shown in FIG. 6A, or they may follow a curved path, as shown in FIG. 5A, or any other path desired, and the projections themselves may curved, when viewed from the top, as shown in FIG. 5A, or squared, as shown in FIG. 6A, or the projections may have any other shape desired, to allow the follower 104 to travel unhindered through the housing 102. In some embodiments, a greater ratio of length L to thickness T than is provided in currently-available designs may also provide for the ability to reduce an overall height of the follower 104.

Continuing with FIG. 3, the slider 120 may have a greater aspect ratio than prior art followers. A greater aspect ratio enhances the anti-tilt capability of the follower for a given length of the follower, and thereby enables a more compact follower with the same or better anti-tilt capability as prior art designs. The slider 120 may have a length L and a width W. The length L may be along a straight or curved longitudinal axis B as illustrated, and the width W may be a measurement of the slider 120 perpendicular to the longitudinal axis B. A thickness T may be a maximum distance the slider 120 protrudes from the side of the follower. The thickness T may also be, in the alternative, a maximum depth the slider 120 can recede into a recess in the side of the follower (e.g., see bearing 712 in FIG. 7). An aspect ratio of the length L to the width W may be selected such that the follower may be compacted (e.g., a shorter length L can be used while still maintaining or improving upon the anti-tilt capability of a follower with a longer length L). That is, the length L may be at least 1.5 times the width W, resulting in an aspect ratio of 1.5. In some embodiments, the length L is at least 5 times the width W, for an aspect ratio of 5. In some embodiments, the length L is at least 10 times the width W, for an aspect ratio of 10. Of note, the larger aspect ratios are achievable by providing a slider 120 with a narrow width W, as measured from the distal side to the proximal side of the slider 120. That is, in contrast to followers that are currently available in which the width W is generally maximized, Applicants have developed a slider 120 in which the width W is generally minimized and/or reduced so as to allow an aspect ratio of 1.5, 5, 10, 15 or more. Of note, in the embodiment illustrated in FIG. 3, the aspect ratio is greater than 10, and greater than 15, or about 16. However, this disclosure is not limited to aspect ratios between 1.5 and 16, and larger aspect ratios are also envisioned.

It should be understood by those skilled in the art that the terms "slider" and "bearing" are not intended to limit this disclosure to the protrusion and channel shown. Instead, it should be understood that the term "slider" is meant to indicate the moving component, i.e., the portion of the follower 104 that moves within the housing 102. Likewise, it should be understood that the term "bearing" is merely meant to indicate the stationary component, i.e., the portion of the housing 102 that guides the movement of the follower 104. It should be understood that the elements can be reversed while preserving the function, with the housing 102 having a protruding bearing and the follower 104 have a recessed slider. Likewise, where two sliders and two bearings are implemented, it should be understood that one slider may be protruding while the second is recessed.

As can be seen in FIG. 3, the yaw axis, or axis A, defined as an axis extending along the center of the distal end 116 of the follower 104, may be curved; this curve is intended to complement a curve of the distal side 108 of the housing 102, thereby allowing the follower 104 to pass unhindered through the housing 102. The proximal end 118 of the follower 104 may also have a complementary curve intended to match the curve at the proximal side 110 of the housing 102. It should be understood that, where the housing 102 is not curved, the yaw axis may or may not be curved. Like with the slider 120 discussed above, it should be understood that, in some embodiments, the yaw axis is not curved at all, even where the housing 102 is curved, so long as the tolerances are chosen to allow the follower 104 to smoothly pass through the housing 102.

In FIG. 3, the follower 104 is shown with protrusions 124 near the proximal end 118. These protrusions 124 provide for added control of the tilt of the follower 104. It should be understood by those skilled in the art that numerous alternate profiles of the protrusions 124 can be used. For example, the protrusions 124 may have one or more non-perpendicular angles, one or more beveled edges, one or more curved edges, two or more edges that are oblique to each other, or at least one edge that is oblique to an inner surface of the housing 102, to name a few non-limiting examples.

Referring briefly back to FIG. 2, the housing 102 may have a housing taper 114 at the distal side 108 of the housing 102. The housing taper 114 provides advantages in certain embodiments. First, the housing taper 114 assists in determining proper orientation of the magazine assembly, in turn improving response time and/or limiting potential damage to the top end 106 from attempts to improperly attach the housing 102 to a firearm. Moreover, the housing taper 114 may enable those wearing gloves or those with smaller hands to more firmly and quickly grasp the housing 102 during outdoor use in inclement weather, or use while under the stress of combat. A housing 102 with a taper have a smaller perimeter than a housing of the same overall width and height without such a feature. The housing taper 114 may provide the ability to reduce the overall size of the housing 102 and is particularly suited to embodiments in which a bottle neck cartridge, spitzer or spire point bullets, or other types of ammunition having a relatively narrower tip or distal end, are used. Material usage is also reduced when the housing taper 114 is present. As illustrated, the taper 114 can extend down a portion of the housing 102 and can extend from a top to a bottom of the housing 102. However, in other embodiments, the taper 114 may extend only part way to the bottom of the housing 102 such that a portion of the housing 102 has a fully rectangular profile when viewed from above or from the bottom.

Returning again to FIG. 3, it can be seen that the follower 104 may likewise have a follower taper 122 at the distal end 116, with the follower taper 122 corresponding to the housing taper 114 in the housing 102. When used with a housing 102 having a housing taper 114, the advantages previously discussed are realized.

In FIG. 3, the slider 120 is shown located along an axis B that is parallel to, and offset from axis A. More specifically, the slider 120 is located closer to the proximal end 118 than both axis A and the follower taper 122 at the distal end 116. FIG. 3 also illustrates in phantom the relationship between a last cartridge and the follower 104, or where the last cartridge would sit when the follower 104 is guiding cartridges through the housing 102. As seen, the desired location of the slider 120 is near to the cartridge shoulder in housings 102 where it is desirable to minimize the width; more specifically, it is desirable that the slider 120 be located near or at a center of the follower 104. That is, the slider 120 may be positioned to balance forces on the cartridge about the center of gravity of the cartridge, thus controlling tilt of the cartridge and follower 104 about a pitch axis. By locating the slider 120 about the center of gravity and near the extreme sides, the leverage or applied moment that would cause the follower 104 to pitch or roll can be reduced. Similarly and relatedly, placing the slider 120 near the geometric center of the follower 104 reduces forces applied to the follower 104 from foreign objects caught between the follower 104 and the housing 102. It will be understood by those skilled in the art that rotation about a pitch axis is associated with a dive or ascent of the distal end 116 relative to a level plane.

Locating the slider 120 near the center of gravity therefore provides more stability to the follower 104 when it is being guided through the housing 102, as compared to the prior art. Due to the geometry most often required for both the cartridge and the magazine interface, the most practical location is often near to the cartridge shoulder in the housing 102. This location also allows for a reduction in the size required from the top of the follower 126 to the bottom 127 of the follower 104. In turn, the follower 104 is more compact than prior art followers, and, where the spring geometry allows, a particularly compact housing 102 may be constructed for use with the compact follower 104 described herein.

Figure 3A:
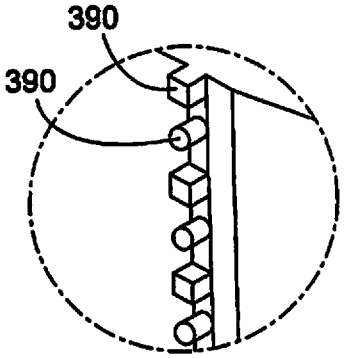
FIG. 3A is a perspective view of a portion of another embodiment of a follower.

The slider 120 may be on a side of the follower 104, and a second slider 120 may be on an opposing side of the follower 104. Although depicted as extending along the entire length of the side of the follower 104, it should be understood that the slider 120 need not necessarily extend along the entire length of the side. All that is necessary is that the slider 120 extend far enough so as to ensure that tilt is controlled to an acceptable tolerance when the follower 104 is traveling through the housing 102 of the magazine 100. In some embodiments, the slider 120 can have a profile, when viewed from above, resembling at least a portion of a rectangle, square, circle, pill-shape, multi-faceted shape, and many others. Moreover, the slider 120 may be interrupted at one or more portions between the top 126 and the bottom 127 of the follower (e.g., an "interrupted slider"). An interrupted slider may also exhibit various profile features or projections 390 when viewed from the side, as seen in FIG. 3A. For example, circular, cylindrical, rectangular, square, multi-faceted, pill-shaped, or other types of projections 390 may be exhibited when viewed from the side. Such features may form an effective curve by their shape and relative position to one another. The axis B of the slider 120 may also be curved in a manner to complement the curvature of the yaw axis A and the curve at the distal side 108 of the housing 102 to enable smooth travel through the housing 102.

Figure 4:
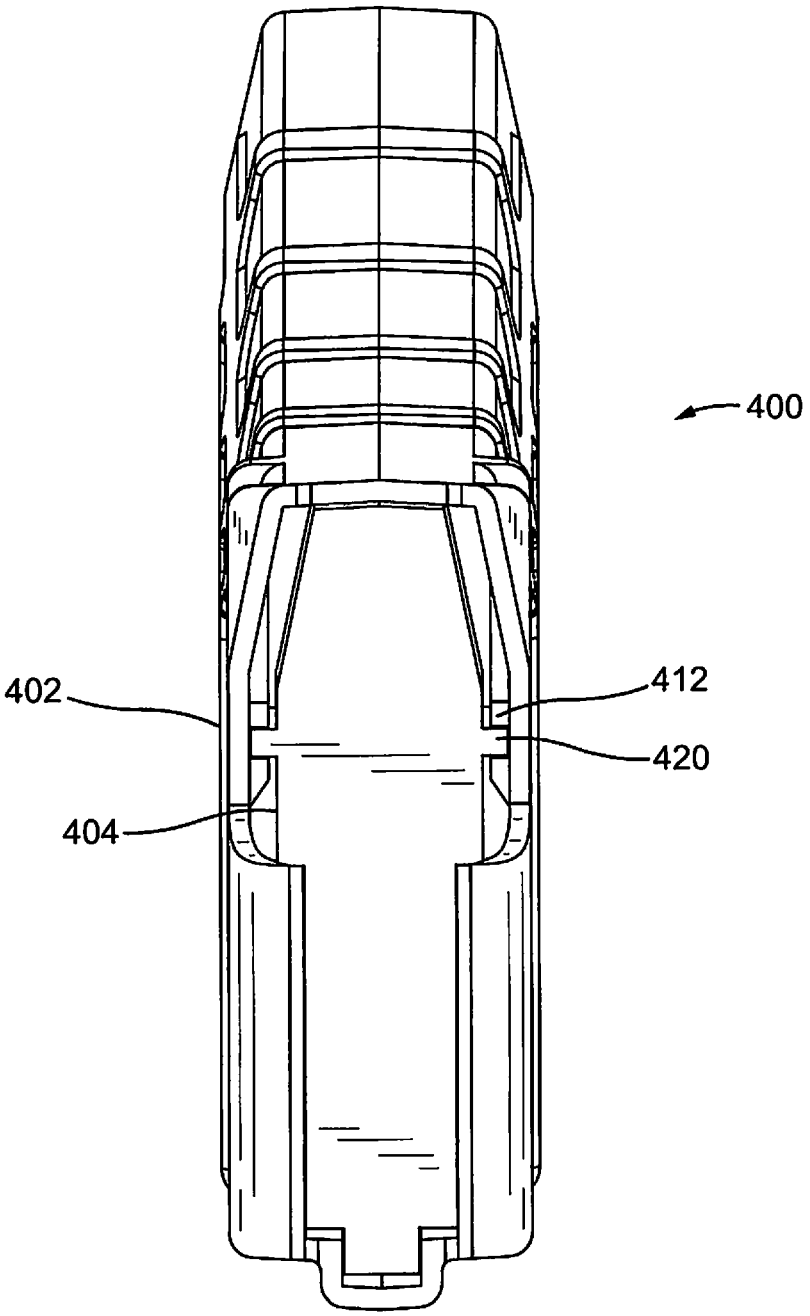
FIG. 4 is a top view of the magazine assembly.

As can further be seen in FIG. 3, the slider 120 of the follower 104 may have a profile that is square or rectangular in shape when viewed from the top. However, in some embodiments, and as shown in FIG. 4, which depicts another embodiment of the magazine assembly 400, the profile of the slider 420 may be trapezoidal in shape, with a complementary trapezoidal bearing 412 in the housing 402, as shown in FIG. 4. This trapezoidal shape may be implemented to optimize or otherwise control any shearing forces that may arise at the interface between the bearing 412 and the slider 420 of the follower 404.

Similarly, FIG. 5 is a top view of another embodiment of the magazine assembly 500 having a housing 502 and a follower 504, in which the bearing 512 and complementary slider 520 have a circular profile when viewed from the top. Again, this variation may be used to control shearing forces that may arising when the bearing 512 and the slider 520 bear against or slide across one another. Other curved profiles such as those including one or more elliptical or parabolic curves can also be implemented.

FIG. 6 depicts another embodiment of the magazine assembly 600, in which the bearing 612 comprises a series of three protrusions 612*a*, 612*b*, 612*c* on the inner wall of the housing 602, with the three protrusions 612*a*, 612*b*, 612*b*, creating a set of two recesses. Likewise, the slider 620 may comprise a set of two protrusions complementary to the two recesses created by the bearing 612 in the housing 602. This series of protrusions 612*a*, 612*b*, 612*c* for interfacing with the slider 620 provides redundancy in the interface of the magazine assembly 600. This redundancy provides for continued functionality in the event one of the components breaks, i.e. avoiding immediate degradation of function or potential failure. This embodiment may be used to reduce the protrusion of each while minimizing the interior intrusion. As further shown in FIG. 6, a housing taper 614 may also be provided, giving, as previously discussed with other embodiments, the advantages associated with a smaller circumference about the housing 602.

Figure 7:
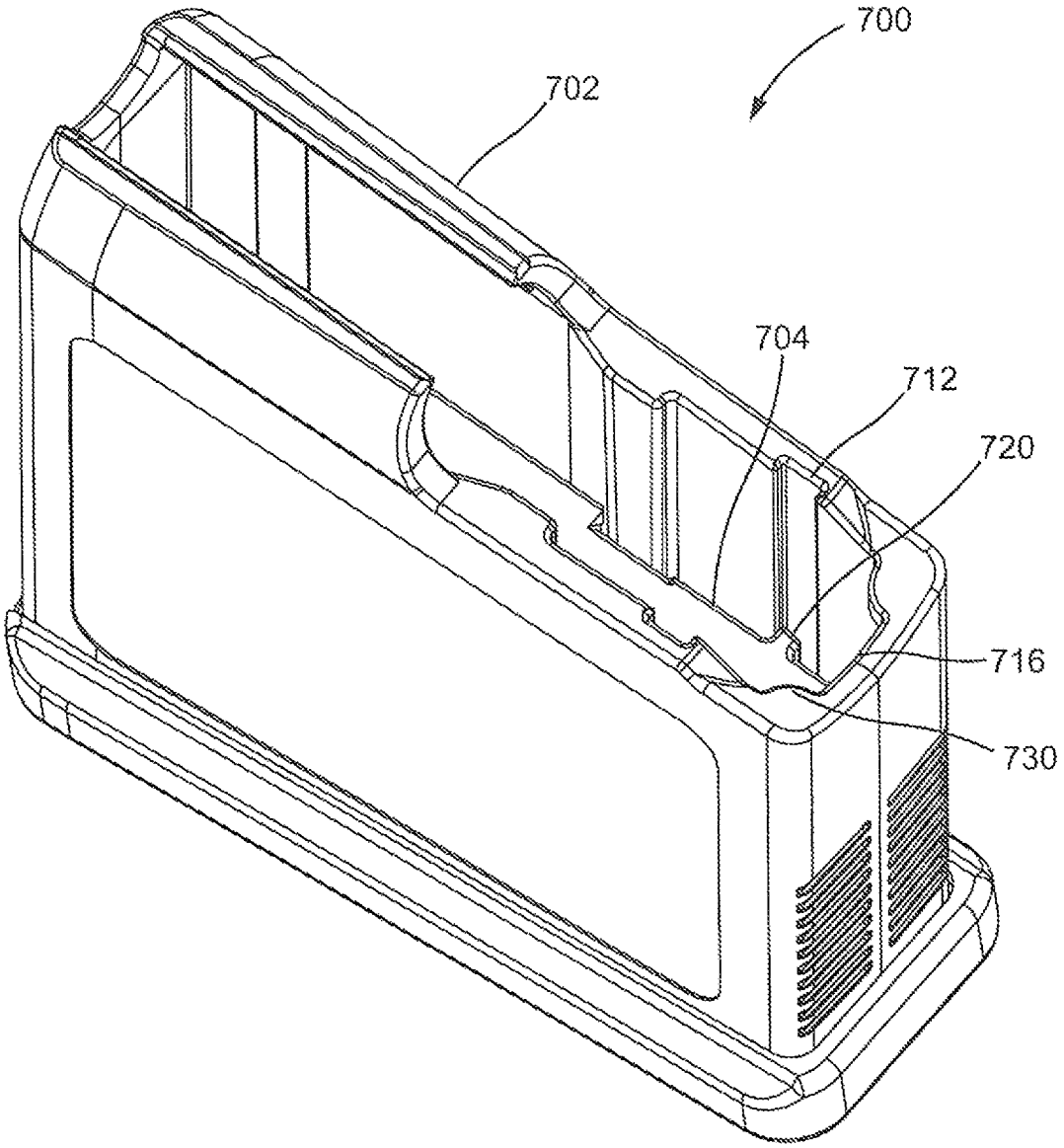
FIG. 7 is a perspective view of another embodiment of a magazine assembly.
Figure 8:
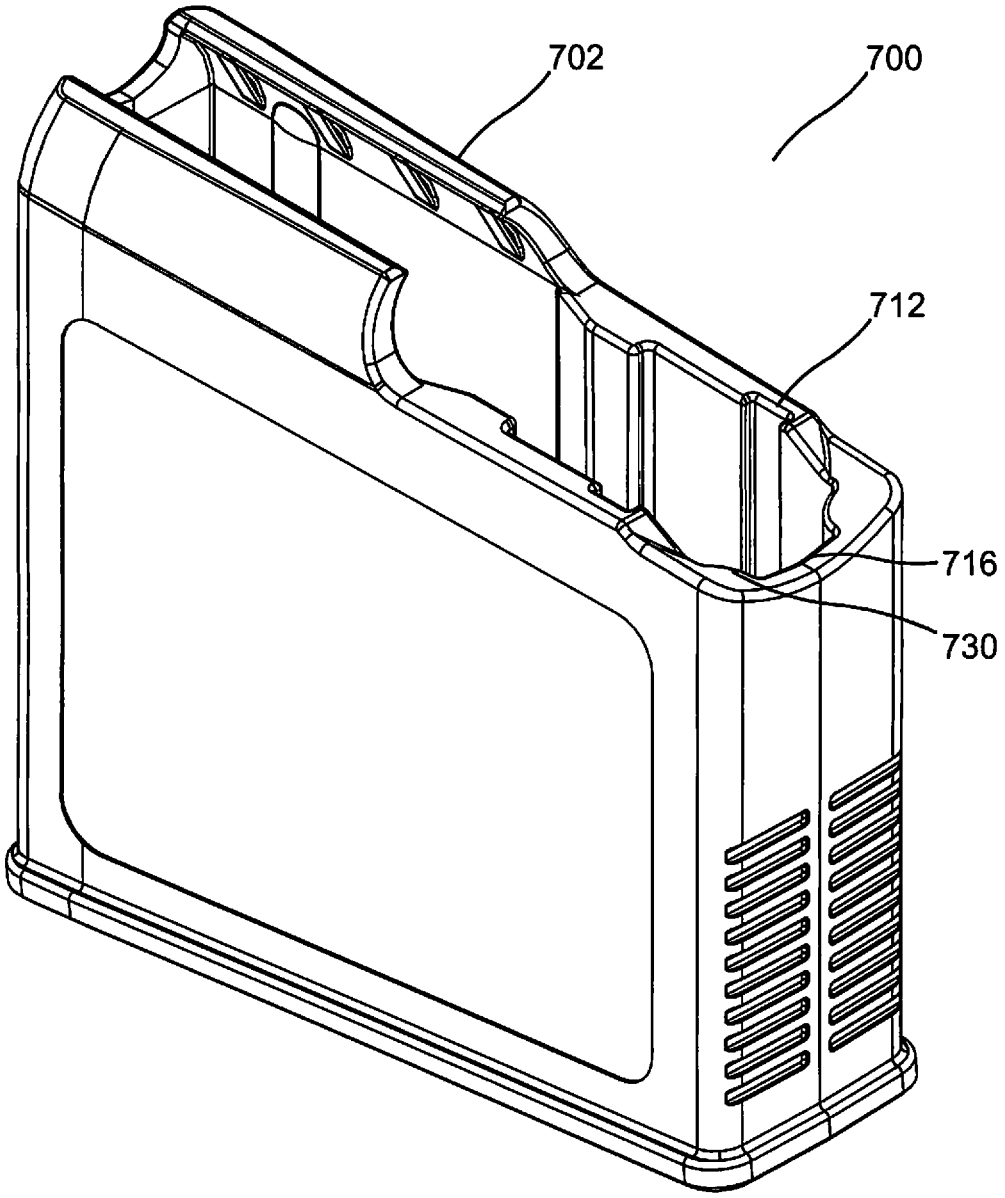
FIG. 8 is a perspective view of a housing of the magazine assembly in FIG. 7.
Figure 9:
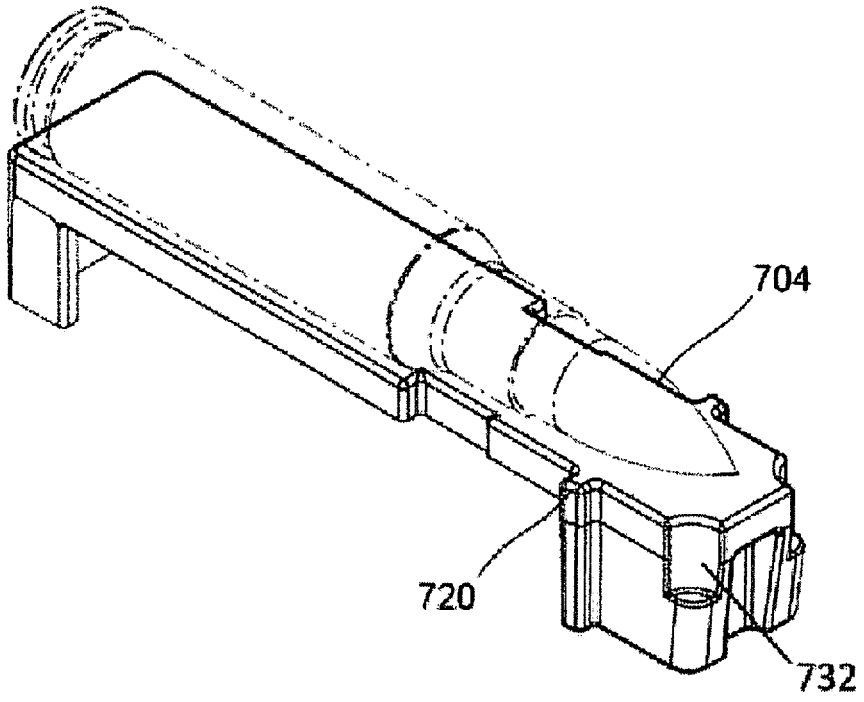
FIG. 9 is a perspective view of a follower of the magazine assembly in FIG. 7.

Turning now to FIGS. 7-9, an embodiment of a magazine assembly 700 having a housing 702 and a follower 704 is depicted. As seen in FIG. 8, the housing 702 is a straight box type housing 702 for use with fewer rounds than the housings illustrated in FIGS. 1-6. For example, as few as three rounds are contemplated for use with this embodiment. The housing 702 may include a ledge 730 at one or both of the distal corners of the housing 702, to provide a stop feature, thereby preventing the follower 704 from sliding out of the housing after a last cartridge is removed from the housing 702. The follower 704, as shown in FIG. 9, may include a complementary recess 732 for abutting the ledge 730 of the housing 702. In this embodiment, the follower 704 achieves the compact anti-tilt features by locating the slider 720 at a position that is removed from the distal end 716 of the follower 704, as seen in FIG. 9.

The embodiment shown in FIG. 9 illustrates how the anti-tilt function is maintained in magazines having a smaller capacity, even without lengthening the design of the follower 704. To better understand the embodiment shown in FIG. 9, however, a description of the prior art is useful. First, for followers intended for use in magazines having a smaller capacity, the length of the follower in the prior art is relatively long, because of various downward projections needed to provide an anti-tilt function. In turn, this necessitates a longer housing to accommodate the long follower, as compared to a tiltable follower having little or no downward projections (no anti-tilt function). In contrast, the embodiment of the anti-tilt follower 704 shown in FIGS. 7-9 does not limit the design of the housing 702 in the same manner, thus enabling both a smaller housing 702 and a smaller capacity magazine, as compared to prior art followers. Moreover, a family of magazines of different capacities may be compatible with the same compact anti-tilt follower, and the smaller capacity magazine does not need to be as long as is required in the prior art.

As can be seen in FIGS. 7-9, in some embodiments the slider 720 of the follower 704 does not necessarily have the same profile as the bearing 712. Moreover, this varied profile may be adapted for use in one or more of the embodiments discussed with reference to FIGS. 1-6. That is, those skilled in the art will understand that, in any or all embodiments, a minimum number of contact surfaces may be chosen so as to sufficiently constrain tilt without overburdening friction and/or manufacturing constraints and tolerances.

Although the figures depict a follower 104 having a mirror-image slider 120 on both sides of the follower 104, it should be understood that this disclosure encompasses embodiments in which the follower 104 has only one slider 120, or in which two or more sliders 120 are not mirror images. As a non-limiting example, one slider 120 may have a square profile, while the other may have a round profile and/or be offset from the first slider 120. As another example, a first slider 720 may be configured to control most of the tilt requirements having looser tolerances, while a second slider 120 may be configured to engage only where tighter tolerances are required. That is, for example, a first slider 120 might control overall length of travel, while a second slider 120 may be configured to engage only where the follower 104 begins to tilt too far out of a desired tilt range. Such variations may provide advantages in manufacturing, such as loosening manufacturing tolerances for some components of the slider 104 or housing 102 while still maintaining strict control over the movement of the follower 104, and thus the overall reliability of the magazine assembly 100 itself.

Although the figures depict followers 104, 604, 704 having a top platform 126 that is flat, it should be understood that this disclosure encompasses the use of any top platform profile suitable for the intended use of feeding cartridges to a firearm chamber. As just a few examples, this disclosure contemplates a follower 104 having a rounded top platform, either concave or convex, as well as embodiments in which the top platform includes a ramp for shifting forces exerted on a cartridge, and top platforms having an angle to minimize contact area. Some top platforms encompassed by this disclosure are discussed in commonly-assigned U.S. Pat. No. 8,166,692 issued May 1, 2012, the contents of which are incorporated by reference herein in their entirety; however, it should be understood that other top platform profiles are encompassed.

It should also be understood that the compact anti-tilt follower 104 and housing 102 of any of the preceding embodiments can be adapted for use with ammunition of a variety of calibers, as well as a variety of firearm classes that use magazines for feeding multiple rounds to the firearm.

In conclusion, the present invention provides, among other things, a compact anti-tilt follower for guiding cartridges towards an exit of a housing of a firearm magazine. The invention may include a housing for a firearm magazine configured to guide an anti-tilt follower through the housing, and it may include an assembly having a compact anti-tilt follower and housing. Those skilled in the art can readily recognize that numerous variations and substitutions may be made in the invention, its use, and its configuration to achieve substantially the same results as achieved by the embodiments described herein. Accordingly, there is no intention to limit the invention to the disclosed exemplary forms. Many variations, modifications and alternative constructions fall within the scope and spirit of the disclosed invention as expressed in the claims.

What is claimed is:

1. A firearm magazine assembly, comprising:
a firearm magazine assembly having:
a follower having:
a platform;
a proximal end;
a distal end; and
at least one slider rail extending down from the platform, wherein the at least one slider rail is positioned between the proximal end and the distal end of the follower, wherein the slider rail is shaped and sized to have an asymmetric aspect ratio; and
a housing having at least one bearing on an inside wall of a side of the housing, wherein the at least one slider rail is configured to interface with the at least one bearing to limit tilt of the follower.

2. The firearm magazine assembly of claim 1, wherein the bearing comprises two ridges or ribs protruding from the inside wall of the side of the housing, the two ridges or ribs forming a first recess for guiding the follower.

3. The firearm magazine assembly of claim 1, wherein the at least one slider has a length measured from a top of the follower downward, and a width, and wherein the asymmetric aspect ratio comprises:
the length at least 1.5 times the width, or at least 5 times the width, or at least 10 times the width, or at least 15 times the width.

4. The firearm magazine assembly of claim 1, wherein:
the platform is shaped to seat a cartridge;
the proximal end has a first surface shaped to engage a proximal interior region of the housing; and
the distal end has a second surface shaped to engage a distal interior region of the housing.

5. The assembly of claim 1, wherein:
the at least one slider rail is located distal of a center of gravity of the follower, the at least one slider rail is located distal of a center of gravity of a last cartridge, or a combination thereof.

6. The assembly of claim 1, wherein:
at least a portion of the at least one slider rail has a curvature shaped to guide the follower along a curvature of at least one rib or ridge of the at least one bearing.

7. The assembly of claim 6, wherein a second rib or ridge of the at least one bearing has a curvature shaped to conform to a curvature of a distal interior region of the housing.

8. The assembly of claim 7, wherein:
the curvature of the at least one slider rail is not identical to the curvature of the second rib or ridge.

9. The assembly of claim 1, wherein the at least one slider rail includes one or more notches protruding from a side of the follower.

10. The assembly of claim 1, wherein the slider comprises a half-moon profile.

11. The assembly of claim 10, wherein the at least one slider rail provides a single contact surface with the bearing, or wherein the at least one slider rail includes a plurality of projections providing a plurality of contact surfaces with the bearing.

12. The assembly of claim 1, wherein:
the at least one slider rail has a length from a top of the follower downward and a thickness oriented outward from a center of the follower, and wherein the asymmetric aspect ratio comprises the length at least 1.5 times the thickness, or at least 5 times the thickness, or at least 10 times the thickness, or at least 15 times the thickness.

13. The assembly of claim 1, wherein:
the follower does not have a slider rail extending from or adjacent to a side of the follower.

14. The assembly of claim 1, wherein:
the inside wall of the housing has a second bearing for receiving a second of the at least one slider rail.

15. A follower assembly for a firearm magazine, comprising:
a platform;
a proximal end;
a distal end;
at least one slider rail extending down from the platform, wherein the at least one slider rail is positioned between the proximal end and the distal end of the follower, wherein the slider rail is shaped and sized to have an asymmetric aspect ratio; and
wherein the at least one slider rail is configured to interface with at least one bearing on an inside wall of a housing of the firearm magazine to limit tilt of the follower.

16. The follower assembly of claim 15, wherein the at least one slider rail has a length measured from a top of the follower downward, and a width, and wherein the asymmetric aspect ratio comprises:
the length at least 1.5 times the width, or at least 5 times the width, or at least 10 times the width, or at least 15 times the width.

17. The follower assembly of claim 15, wherein the at least one slider rail has a length from a top of the follower downward and a thickness oriented outward from a center of the follower, and wherein the asymmetric aspect ratio comprises the length at least 1.5 times the thickness, or at least 5 times the thickness, or at least 10 times the thickness, or at least 15 times the thickness.

18. A method of using a firearm magazine assembly, the method comprising, providing:

a follower having a platform, a proximal end, a distal end, and at least one slider rail extending below the platform and on a first side of the follower, wherein the at least one slider rail is located distal of a center of gravity of the follower, the at least one slider rail is located distal of a center of gravity of a last cartridge, or a combination thereof; and a housing shaped to receive the follower, the housing having a first wall having a first bearing for receiving at least a portion of the at least one slider rail; wherein the at least the portion of the at least one slider rail is shaped to interface with the first bearing to limit tilt of the follower.

19. The method of claim 18, wherein the first bearing comprises two ridges or ribs protruding from an inside of the first wall, the two ridges or ribs forming a recess for guiding the follower.

20. The method of claim 18, wherein the at least one slider rail includes one or more notches protruding from the first side of the follower.

* * * * *